United States Patent [19]

Gay

[11] 4,147,202

[45] Apr. 3, 1979

[54] CONTINUOUS CASTING INGOT MOULD

[75] Inventor: Pierre Gay, La Tour en Jarez, France

[73] Assignee: Clesid S.A., Saint-Chamond, France

[21] Appl. No.: 829,091

[22] Filed: Aug. 30, 1977

[51] Int. Cl.[2] ..... B22D 11/04

[52] U.S. Cl. ..... 164/436

[58] Field of Search ..... 164/418, 436, 89, 443, 164/444, 427, 441, 442, 425, 297, 435

[56] References Cited

U.S. PATENT DOCUMENTS

| | | | |
|---|---|---|---|
| 3,735,801 | 5/1973 | Burkhardt | 164/436 |
| 3,913,658 | 10/1975 | Schmid | 164/436 X |

*Primary Examiner*—Francis S. Husar
*Assistant Examiner*—John S. Brown
*Attorney, Agent, or Firm*—Haseltine, Lake & Waters

[57] ABSTRACT

A continuous casting ingot mould comprises spaced apart front and back plates between which are arranged two lateral plates. The front and back plates are mounted respectively on a movable frame and a stationary frame provided with means for supporting and clamping the side plates between the front and back plates, the supporting means including two articulations slideable axially along two columns fixed to the stationary frame and extending perpendicular thereto, one articulation being fixed to the movable frame and the other being mounted on the movable frame to slide relative thereto in a direction parallel to a line joining the axes of the columns and perpendicular thereto.

8 Claims, 6 Drawing Figures

FIG 2
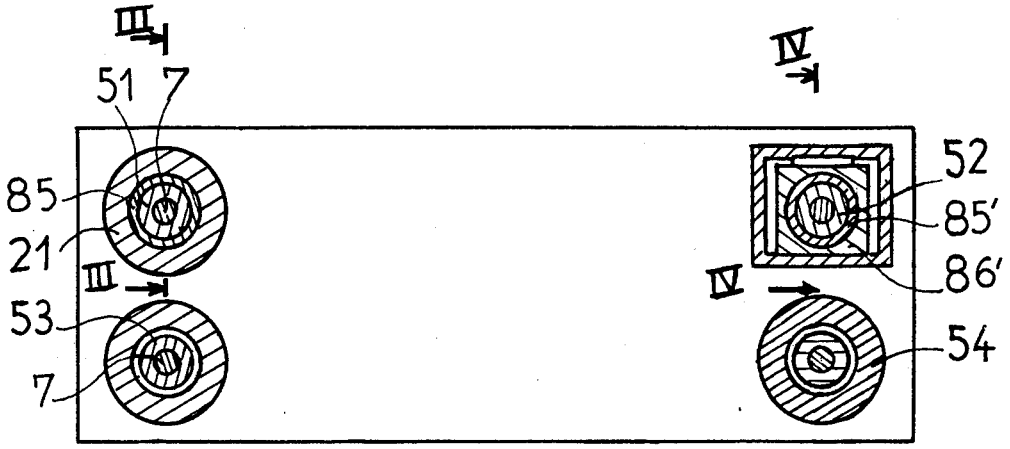
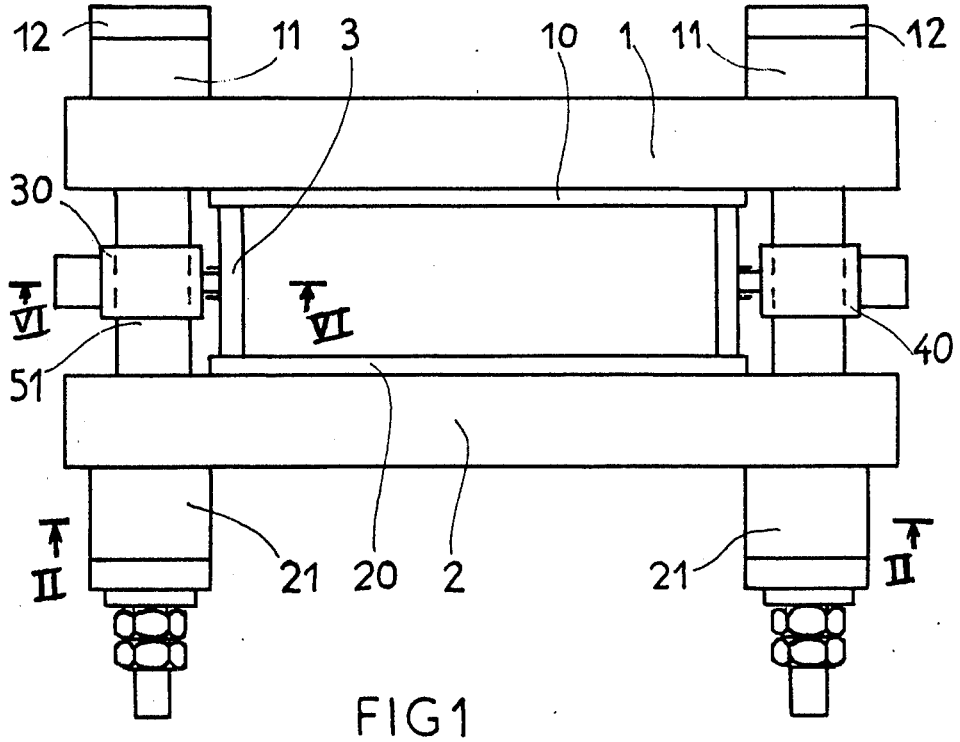
FIG1

CONTINUOUS CASTING INGOT MOULD

This invention relates to a continuous casting ingot mould, more particularly an adjustable ingot mould for the continuous casting of slabs of different widths.

The production programs of machines for the continuous casting of slabs generally require slabs to be produced in varying sections. Moulds of different sections are therefore required.

To reduce the number of moulds, the latter are made adjustable so that different widths can be obtained for a given thickness. Also, in order further to reduce the investment in mould equipment, common components are used to make moulds which are capable of casting slabs of different widths.

A mould of this kind generally consists of a front plate and a back plate which are adapted to be moved apart and between which are disposed two side plates. The front plate and the back plate, which are normally water-cooled copper components, are each mounted on a frame, one of the frames being stationary and the other movable. The stationary frame is provided with means for supporting the movable frame, which can be clamped on the stationary frame to lock the side walls disposed between the two front and back walls. To this end, means for clamping the movable frame, e.g. adjusting screws, generally bear on the stationary frame.

For the purposes of adjustment, the side plates are released from the clamping force to which they are subject between the front and back plates by releasing the screws, the side plates are moved to give the required width, and then the side plates are clamped by tightening the screws.

In the moulds used heretofore, there is the danger of the plates jamming during these operations, and to obviate this, positioning means have to be used outside the mould. The width adjustment of the mould is carried out when the mould is in place on the machine and it is difficult to obtain access to the different mould components, and this is at a time when, in these conditions, it is not possible to use handling equipment outside the mould capable of accurately positioning the movable elements.

It is an object of the invention to provide a new mould in which these disadvantages are avoided.

More particularly, it is an object of the invention to provide a mould of which the components can be positioned without superfluous connections, so that the risk of jamming is obviated.

To this end, according to the invention there is provided a continuous casting ingot mould comprising a front plate; a back plate adapted to be spaced from said front plate; two lateral plates disposed between said front and back plate; a stationary frame; a movable frame; means supporting said front and back plates on a respective one of said stationary and movable frames; clamping means for said movable frame with respect to said stationary frame for clamping said side plates between said front and back plates; and support means for supporting said movable frame with respect to said stationary frame comprising two columns fixed to said stationary frame and arranged with that axes perpendicular to said stationary frame and two articulations each mounted to slide axially on a respective one of said columns, one of said articulations being fixed to said movable frame and the other of said articulations being mounted to slide relative to said movable frame in a direction parallel to a plane extending through said axes of said columns and transverse to said axes of said columns.

In a preferred embodiment of the invention, said articulations comprise ball joints each comprising a first element mounted to be axially slideable along said respective column, and a second element, said second element of said ball joint of said one articulation being fixed to said movable frame and said second element of said ball joint of said other articulation being mounted to slide relative to said movable frame.

The invention will be more fully understood from the following description of an embodiment thereof, given by way of example only, with reference to the accompanying drawings.

In the drawings:

FIG. 1 is a top plan view of an embodiment of a mould according to the invention;

FIG. 2 is a section through the mould on the line II—II in FIG. 1;

Figure 3:
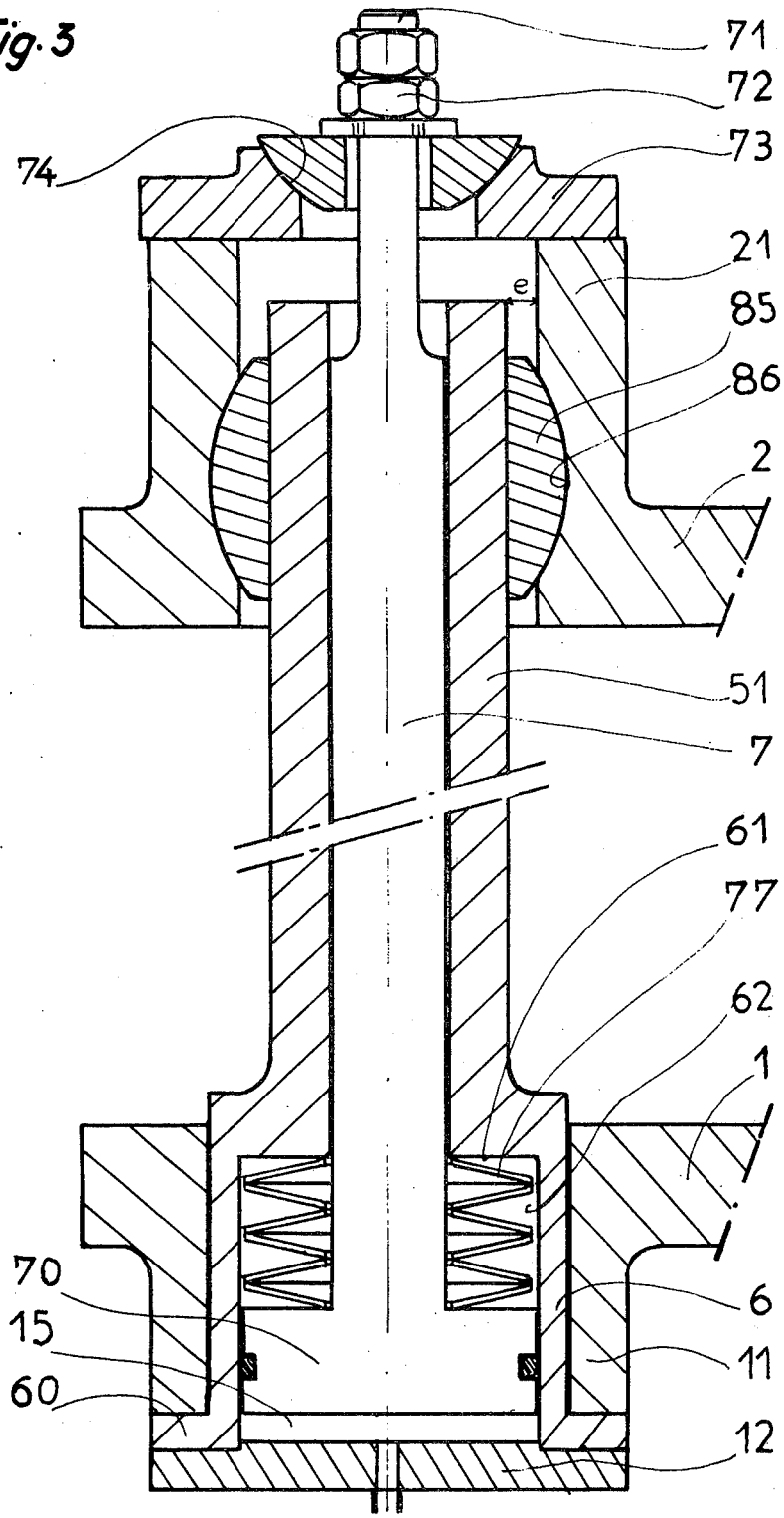
FIG. 3 is an enlarged view of a supporting column of the movable frame in section on the line III—III in FIG. 2.

The mould shown in FIG. 1 comprises a stationary frame 1 and a movable frame 2, on which a water-cooled copper back plate 10 and front plate 20 are respectively fixed. Two side plates 3 and 4 are disposed between the two copper plates 10,20. Four cylindrical bosses 11 are disposed on the stationary frame 1 and four similar bosses 21 are disposed on the movable frame 2.

Four columns 51–54 are fixed on the four bosses 11 of the stationary frame 1. As shown in FIG. 3, each column has a cylindrical base 6 which fits in a bore of the same diameter formed in the corresponding boss 11, the cylindrical base being held at its end by a fixing flange 60 which can be fixed to the end of the boss 11 by bolts bearing on a plate 12 closing the chamber formed by the interior of the cylindrical base 6.

The end of each column 51–54 can penetrate into the interior of a bore of the corresponding boss 21 of the movable frame 2, said bores having a larger diameter than the column diameter so as to leave a clearance e.

The four columns 51–54 are tubular and a tie rod 7 is slidable inside each column.

At the end adjacent the stationary frame 1 each tie rod 7 has a widened portion 70 which forms a piston and slides inside a bore 62 formed in the cylindrical base 6 of the column, the assembly thus forming a jack for axial movement of the rod 7.

The other end 71 of rod 7 is screwthreaded and is engaged by a nut 72 clamping a circular plate 73 bearing on the end of the corresponding boss 21. Nut 72 bears on the plate 73 through the agency of a member with a spherical surface 74 allowing the axis of the tie rod to move out of alignment with respect to the axis of the corresponding boss 21.

From FIG. 3 it will be seen that column 51 is connected to the corresponding boss 21 of the movable frame 2 by means of a ball joint centred on the axis of the column. The male part 85 of the ball joint has an axial bore of a diameter equal to that of the column 51 and is slideable relative to the column. The female part is formed by a hollow spherical surface 86 formed on the boss 21 and of a diameter equal to that of the male part.

Figure 4:
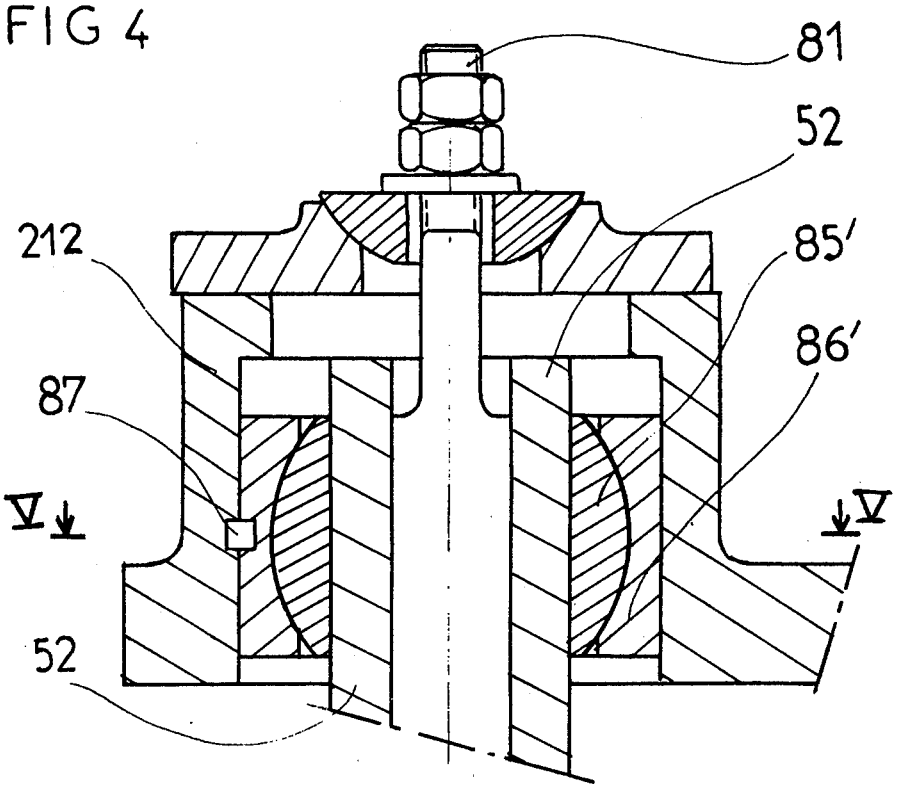
FIG. 4 is a section on the line IV—IV in FIG. 2 showing the other supporting column of the movable frame.
Figure 5:
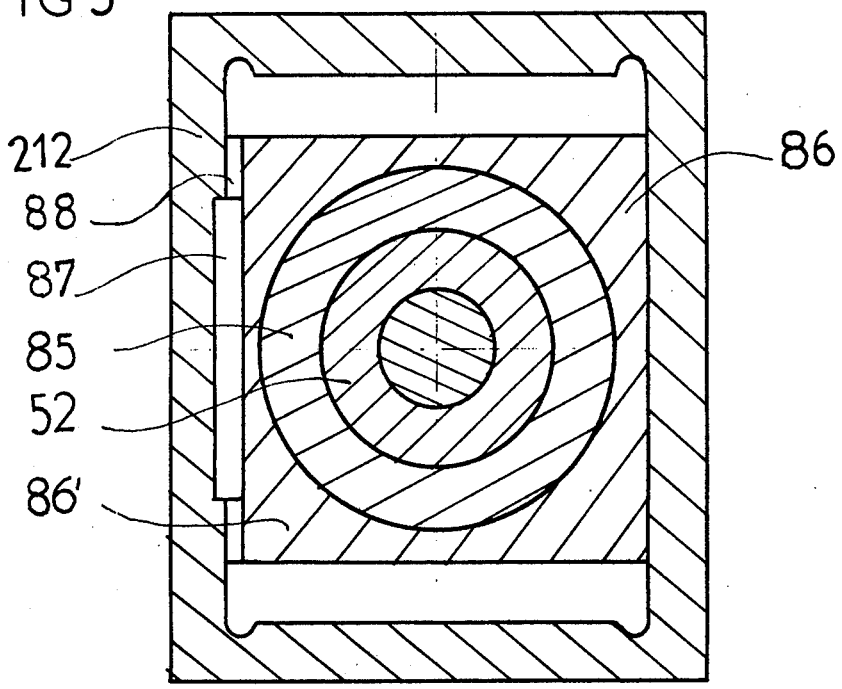
FIG. 5 is a section through the other column on the line V—V in FIG. 4.

FIGS. 4 and 5 show the connection between the second column 52 and the movable frame. As in the previous case, column 52 is connected to the corresponding boss 212 of the movable frame 2 by a ball joint centered on the axis of the column, and of which the first male element 85' is slideable along the column 52. However in this case the second female element 86' comprises a slide displaceable with respect to the movable frame in a direction parallel to the plane passing through the axes of the columns 51 and 52. To this end, as shown in FIG. 5, the boss 212 for column 52 is provided with a bore having a square-sectioned part in which the slide 86' can move. A key 87 is fixed on the inner wall of the recess and slides in a corresponding keyway 88 formed on the slide 86'. In this way, slide 86' is displaceable in a direction parallel to the plane passing through the axes of the columns 51 and 52.

In the case of the other two columns 53 and 54, there is no connection whatever between the column and the corresponding boss of the movable frame so that, as a result of clearance (e), frame 2 can assume various orientations with respect to columns 53 and 54, thus allowing, for example, a conical-section mould to be formed.

The minor side plates 3 and 4 of the mould are supported by the columns 51 and 52 through the agency of devices 30 and 40 which also allow the position of the minor side plates to be adjusted. One of these devices, 30, is shown in detail in FIG. 6, the other device being similar.

Figure 6:
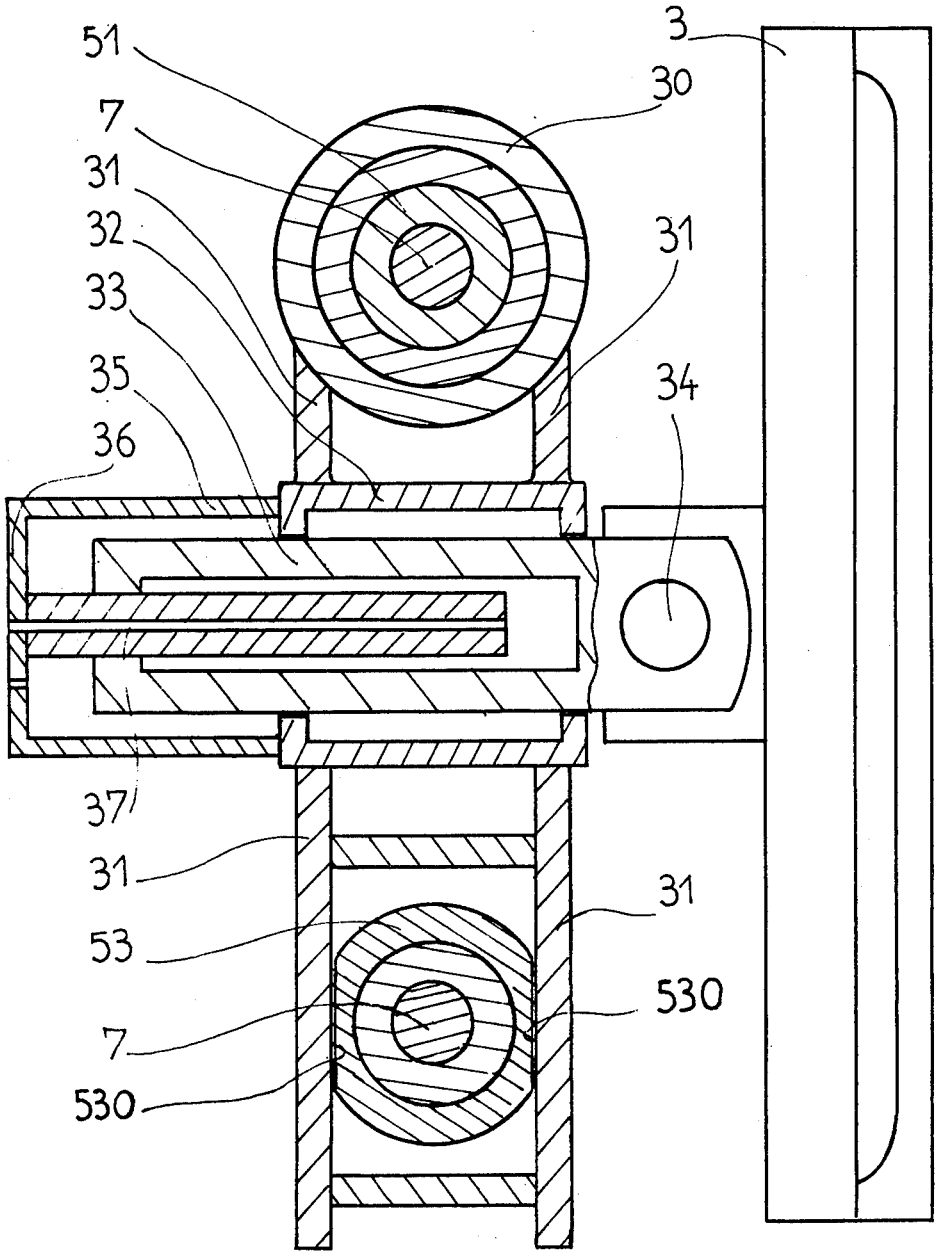
FIG. 6 is a section on the line VI—VI in FIG. 1 showing a side plate and its support means.

FIG. 6 shows the columns 51 and 53. The device for supporting the wall 3 comprises a cylindrical member 30 formed with an inside bore of the same diameter as that of the column 51 and through which said column extends. Two vertical arms or uprights 31, framing the lower column 53, are fixed on the cylindrical member 30. Preferably, column 53 is provided with plane vertical faces 530 which bear on the two arms 31 to give free vertical play of the arms on the column while ensuring that the assembly is held vertical.

A cylindrical bush 32 in which a rod 33 is slidable transversely of the column axis is fixed on the arms 31. Rod 33 is connected to side plate 3 by an articulation 34 and forms the plunger piston of a double-acting jack, the cylindrical body 35 of which is fixed on the bush 32 and closed by an end plate 36. A rod 37 guides the rod 33. By bearing on the columns 51 and 53 it is thus possible to adjust the position of the side plate 3. A similar system enables the position of side plate 4 to be adjusted by bearing on the columns 52 and 54.

The above-described device operates as follows.

When the mould is in operation, the minor side plates 3 and 4 are clamped between the stationary frame 1 and the movable frame 2 by means of the rods 7, this being effected preferably mechanically. For example, springs 77, e.g. stacks of Belleville washers, may be interposed between the piston 70 connected to the rod 7 and the end 61 of chamber 60 so as to urge the movable frame 2 towards the stationary frame 1.

When the mould is to be released for the purpose of moving the minor side plates, oil is admitted to the jack chamber situated between the piston 70 and the end plate 12 so as to move the rod 7 and compress the spring 77. This operation may be carried out simultaneously on the four tie rods and when the frame 2 is released the position of the minor side plates can be adjusted.

The pressure in the jack is then reduced to lock the minor side plates by clamping them between the movable frame and the stationary frame by means of the four rods. However, unlike the previous device, there is no risk of jamming in the above described device because for the two bottom tie rods 53 and 54 are free within the limits of the clearance e, and the movable frame can therefore be considered as being suspended about a line passing through the two ball joint centres. While the two centres of the ball joints are constrained to remain each on the axis of the rod along which the ball joint slides, one of the ball joints 85, 86 can slide perpendicularly to the axis with respect to the boss 212 of the movable frame in which it is mounted. Consequently everything occurs as if the movable frame was suspended about an axis constrained only to remain in the plane extending through the axes of the columns 51, 52, the axis passing through a point in turn constrained to remain on the axis of the column 51. Thus positioning of the mould is achieved without excessive connections and hence without the risk of jamming.

Once the mould has been clamped by the nuts 72 engaging the screw-threaded ends of the tie rods 7, which provides some tension for the springs, the mould can be unlocked without changing the position of the nuts, simply by applying pressure to the jacks formed by the bases 70 of the tie rods. When the pressure is reduced, the four tie rods return to their clamping positions. It is thus possible to adjust the width of the mould without having to obtain access to the clamping elements.

It will be seen that as a result of the above arrangement and particularly the clearance between the bottom columns and corresponding bosses of the movable frame, there is no disadvantage if the rods are not all clamped simultaneously, e.g. because of different response times of the jacks.

The invention is obviously not intended to be limited to the details of the above described embodiment, but covers other embodiments. For example, the clamping means, which have been described in detail only by way of example, may be replaced by equivalent means. The ball joints described above may be replaced by other universal joints and the clamping means may be embodied in many other ways.

What is claimed is:

1. A continuous casting ingot mould comprising:

a front plate;

a back plate adapted to be spaced from said front plate;

two lateral plates disposed between said front and back plates;

a stationary frame;

a movable frame;

said front and back plates being disposed on a respective one of said stationary and movable frames;

clamping means for said movable frame with respect to said stationary frame for clamping said lateral plates between said front and back plates; and support means for supporting said movable frame with respect to said stationary frame comprising two columns fixed to said stationary frame and arranged with their axes perpendicular to said stationary frame and two articulations each mounted to slide axially on a respective one of said columns, one of said articulations being fixed to said movable frame and the other of said articulations being mounted to slide relative to said movable frame in a direction parallel to a plane extending through said axes of said columns and transverse to said axes of said columns.

2. An ingot mould according to claim 1, wherein said articulations comprise ball joints each comprising a first element mounted to be axially slideable along said respective column, and a second element, said second element of said ball joint of said one articulation being fixed to said movable frame and said second element of said ball joint of said other articulation being mounted to slide relative to said movable frame transversely of said axes of said columns.

3. An ingot mould according to claim 2, wherein said second element of said ball joint of said other articulation is in the form of a slide displaceable in a recess formed on said movable frame in said direction.

4. An ingot mould according to claim 1 wherein said clamping means comprise at least three tie rods, two of said tie rods being mounted to be coaxial with said two support columns, the other of said tie rods extending through said movable frame with clearance, said rods having ends on which nuts are engaged for clamping said movable frame by means of spherical bearing surfaces.

5. An ingot mould according to claim 4, wherein each of said two tie rods includes a part arranged to act as a piston and slidable inside a cylinder formed in said respective column, said assembly forming a jack for displacement of said rod along the axis of said respective column.

6. An ingot mould according to claim 5, wherein each said jack includes a chamber for admission of a fluid for moving said piston in the direction to separate said movable frame from said stationary frame against the action of a resilient member bearing on said piston in a direction to clamp said movable frame.

7. An ingot mould according to claim 1, comprising two further columns and wherein said clamping means comprise four tie rods each coaxial with and passing through a respective column fixed on said stationary frame, said four columns being centered at the apices of a rectangle, said articulation being disposed on said two columns defining one side of said rectangle, the other said columns extending through said movable frame with clearance.

8. An ingot mould according to claim 7, comprising two said plate support members, each support member defining a bore through which one of said columns bearing a ball joint is slidable, and two plane faces bearing on one of said other columns without a ball joint, each side plate being connected to a support member by a means for adjusting the position of said side plate.

* * * * *